United States Patent [19]

Lovas et al.

[11] 4,143,825

[45] Mar. 13, 1979

[54] METHOD AND APPARATUS FOR PICKING UP A YARN AND TRANSFERRING IT TO A PIRN AFTER A BOBBIN CHANGE

[75] Inventors: Kurt Lovas, Ingolstadt; Hans Landwehrkamp, Lenting, both of Fed. Rep. of Germany

[73] Assignee: Schubert & Salzer, Ingolstadt, Fed. Rep. of Germany

[21] Appl. No.: 784,790

[22] Filed: Apr. 5, 1977

[30] Foreign Application Priority Data

Apr. 17, 1976 [DE] Fed. Rep. of Germany ..... 2616965

[51] Int. Cl.[2] ..... B65H 54/02; B65H 67/04

[52] U.S. Cl. ..... 242/18 PW

[58] Field of Search ..... 242/18 PW, 18 A, 18 R, 242/25 A; 57/34 TT

[56] References Cited

U.S. PATENT DOCUMENTS

| | | | |
|---|---|---|---|
| 2,572,138 | 10/1951 | Griset, Jr. | 57/34 TT |
| 2,800,762 | 7/1957 | Wurmli | 57/34 TT |
| 2,855,747 | 10/1958 | Rich | 57/34 TT |
| 2,949,722 | 8/1960 | Henry | 57/34 TT |
| 3,971,517 | 7/1976 | Matuura et al. | 242/18 PW |
| 3,974,972 | 8/1976 | Egli et al. | 242/18 PW |

*Primary Examiner*—Stanley N. Gilreath

*Attorney, Agent, or Firm*—Bailey, Dority & Flint

[57] ABSTRACT

A method and apparatus for picking up a yarn and transferring it to an empty pirn following exchange with a full bobbin on a yarn winding unit on which yarn is extended between a pair of yarn draw-off rolls and a yarn holding device includes a pair of auxiliary draw-off rolls intermediate the draw-off rolls and the yarn holding device for positively drawing yarn from the draw-off rolls to produce a forced conveyance zone therebetween in which the yarn is conveyed essentially without strain and a yarn grabber device for grasping the yarn in the forced-conveyance zone and drawing out the yarn far into the region of a yarn catching device carried on the pirn.

5 Claims, 3 Drawing Figures

METHOD AND APPARATUS FOR PICKING UP A YARN AND TRANSFERRING IT TO A PIRN AFTER A BOBBIN CHANGE

BACKGROUND OF THE INVENTION

In exchanging an empty bobbin for a full bobbin on a yarn winding unit for winding a yarn reserve thereon, the practice is known of severing the yarn leading to the full bobbin, feeding the remaining end of the yarn to a yarn holding device, then after exchange of the full bobbin for an empty pirn to seize the yarn extending to the yarn holding device and draw it out as far as the empty pirn and pinch it between the end of the empty pirn and a part adjoining the latter, which revolves with the empty pirn, whereupon the yarn extending between the yarn holding device and the point of pinch is severed at a fixed distance from the empty pirn (West German OS No. 23 32 327). Since the yarn holding device, particularly with thicker yarns, cannot continue to draw off the yarn when drawn out to the pirn because of the sharp deflection of the yarn over the edge of the grabber, the yarn dams up in an uncontrolled way between the draw-off rolls and the grabber, which may lead to difficulties in winding, at least until the excess length of yarn is consumed. These disadvantages are to be eliminated in accordance with the present invention.

Accordingly, an important object of the present invention is to eliminate any yarn damming during a bobbin change between the draw-off rolls and the yarn grabber, and to insure that the yarn gets safely wound onto the new pirn at the start.

Another important object of the present invention is the provision of apparatus for use with yarn winding machinery to eleiminate any yarn damming during a bobbin change.

SUMMARY OF THE INVENTION

This problem of yarn damming during a bobbin change is solved in accordance with the invention if the yarn extending to the yarn holding device is drawn off positively at least over a partial section to produce a forced-conveyance zone wherein the yarn is grasped for drawing out into the region of the pirn. The additional length of yarn for the drawing out of the yarn up into the region of the pirn may in that case be created by stretching the yarn or by slip.

Apparatus for carrying out the invention includes auxiliary draw-off rolls arranged between the draw-off rolls and the yarn holding device. The auxiliary draw-off rolls being preferably arranged beside the draw-off rolls with yarn guide members being provided between the draw-off rolls and the auxiliary draw-off rolls. Advantageously, the draw-off rolls and the auxiliary draw-off rolls have a common driven draw-off roll, but individual pressure-rolls.

The drawing of the yarn out of the yarn forced-conveyance zone into the region of the pirn is effected by means of a grabber which at its working end carries two yarn deflector guides and can be moved with these into the working range of a yarn catcher device carried on the pirn.

In accordance with the invention, the yarn deflector guide remote from the center of the pirn changes over into a recess which, with reference to its yarn transfer position, runs obliquely in direction to the working end of the grabber and to the yarn forced-conveyance zone. At the end of the recess, a stationary cutting edge is provided. The yarn deflector guide toward the center of the pirn is advantageously formed as a U-shaped recess which at the edge of it remote from the yarn forced-conveyance zone is open. It is advantageous if the yarn catcher device is formed as a yarn catcher beak which is orientated in the direction of rotation of the pirn and is arranged on a pirn disc which in diameter projects beyond the pirn. The yarn deflector guide remote from the center of the pirn has a working position in the range of the yarn catcher beak which reaches further towards the axis of the pirn than the yarn deflector guide next to the center of the pirn. It has proved particularly advantageous if the pirn disc exhibits a recess which partially receives the pirn and an outer periphery which projects beyond the end of the pirn in a ring and slopes off conically in the direction towards the center of the pirn.

Because of the positive drawing-off of the yarn, the yarn, even with larger yarn counts, always gets definitely drawn off so no damming up of yarn occurs in front of the grabber which later would have to be broken up again upon release of the yarn by the grabber. Irregularities in the winding of the yarn and trouble occasioned by them are therefore avoided. Because of the presence of a positive yarn draw-off, a controllable cutting attachment is not necessary. The yarn gets guided positively into the region of a stationary cutting edge because of the cooperation of the yarn draw-off and the yarn catcher beak. By that means, the separation of the yarn is also effected always in the same working phase.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The invention may be applied to different textile machines, for example, to a winder or an open-end spinning frame. Since the problem of the damming up of material between the draw-off mechanism and the grabber in the case of open-end spinning frames is particularly acute because of the desired uninterrupted production of yarn, reference will be made below to an open-end spinning frame. Furthermore, since such spinning frames are well known, only so much of a spinning frame and the yarn winding machinery associated therewith are illustrated as is necessary for an understanding of the present invention.

Figure 1:
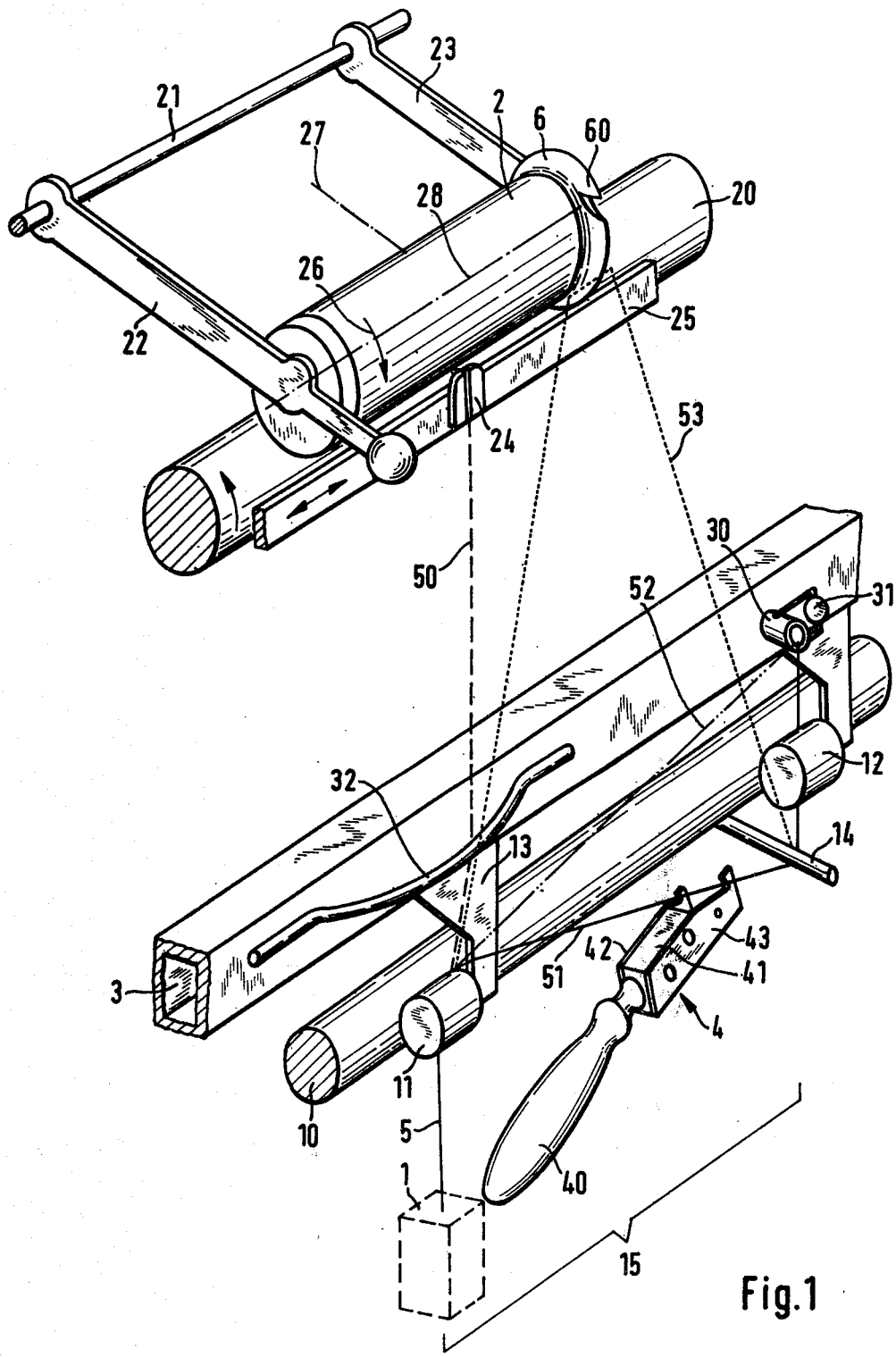
FIG. 1 is a schematic perspective view illustrating apparatus constructed in accordance with the present invention as well as illustrating the conventional parts of a yarn spinning and winding unit necessary to understand the invention.

In the case of the open-end spinning frame in accordance with FIG. 1, the yarn 5 produced in a yarn delivery unit illustrated diagrammatically at 1, is delivered to a winding unit and is drawn off continuously by a draw-off mechanism consisting of two draw-off rolls 10, 11 and wound onto a bobbin or pirn 2 which in the working position as shown rotates by frictional drive against a bobbin roll 20. The pirn 2 in the embodiment shown is gripped resiliently between two bobbinholders 22 and 23 pivotable about an axis 21. In front of the bobbin roll 20, a yarn guide 24 is arranged which is attached to a traversing rod 25 across which it may automatically traverse.

Between the draw-off rolls 10, 11 and the bobbin roll 20, a suction channel 3 is fixed having a yarn holding device 30 arranged outside the run 50 of the yarn and formed as a suction air nozzle which can be closed off by a cover 31. In addition, a yarn tension equalizer bow 32 is fitted to the suction channel 3. Between the draw-off rolls 10, 11 and the yarn holding device 30, auxiliary draw-off rolls 10, 12 are arranged at a suitable point. In order to be able to grip the yarn 5 easily between the draw-off rolls 10, 11 and the auxiliary draw-off rolls 10, 12, as is explained again later in greater detail, the auxiliary draw-off rolls 10, 12 are advantageously arranged beside the draw-off rolls 10, 11. Between the draw-off rolls 10, 11 and the auxiliary draw-off rolls 10, 12 yarn guide members 13 and 14 are provided. In the advantageous embodiment shown, the draw-off rolls 10, 11 and the auxiliary draw-off rolls 10, 12 include a common driven draw-off roll 10, but individual pressure rolls 11 and 12, respectively.

By the arrangement of draw-off rolls 10, 11 and auxiliary draw-off rolls 10, 12 side by side, a section 51 of yarn occurs which extends essentially transverse to the run 50 of the yarn. This is particularly advantageous for the seizing of the yarn 5 and for drawing it out as far as into the region of a yarn catcher device arranged at the edge of the pirn. The yarn catcher device may be made in various ways and be arranged on the pirn 2 or on the pirn disc 26. In accordance with FIG. 1, which shows the preferred embodiment, a yarn catcher beak 60 is arranged on the periphery of the pirn disc 6, orientated in the direction 26 of rotation of the pirn 2.

Figure 2:
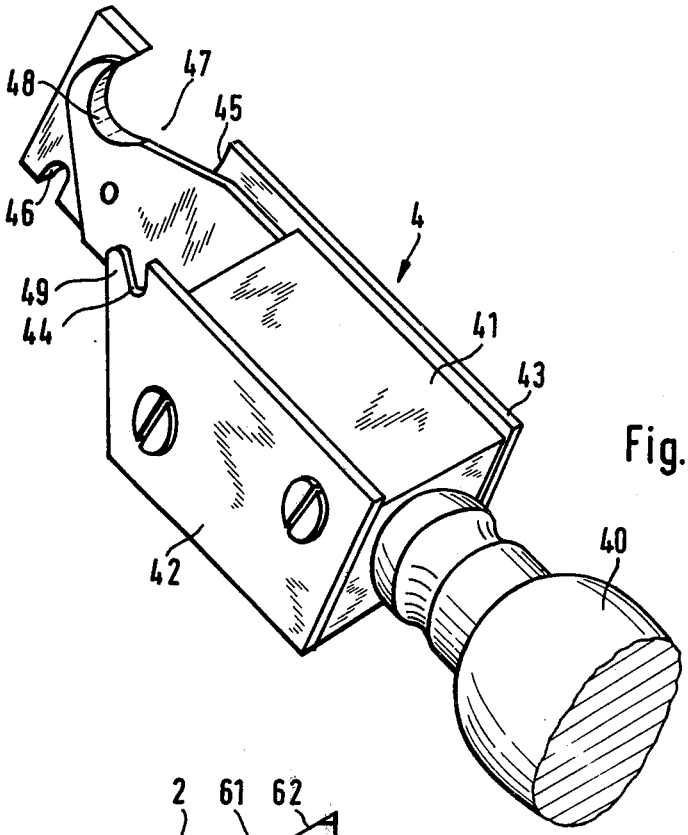
FIG. 2 is a perspective view illustrating a yarn grabber device constructed in accordance with the present invention.

For seizing the yarn 5, a yarn grabber device is provided. This grabber 4 (FIGS. 1 and 2) includes a handle 40 which carries the base body 41. The base body 41 which exhibits essentially the shape of a brick carries on opposite sides a pair of plates 42 and 43 having yarn deflector guides 44 and 45, respectively. These yarn deflector guides in each case lie at the end of the plate 42 or 43 remote from the handle, and on the long edges of the plates 42 and 43 which lie on the same side of the base body 41 (FIG. 2). The plate 43 exhibits at the end remote from the handle 40 a further recess 46 on the long edge remote from the yarn deflector guide 45.

The device described structurally above operates as follows:

During the normal spinning process, the yarn 5 gets drawn off from the yarn delivery unit 1 (FIG. 1) by the draw-off rolls 10, 11 and wound onto the pirn 2. When this is full so that the full bobbin is to be exchanged for an empty pirn 2, the full bobbin (not shown) is removed by raising the bobbin holder 22 from the bobbin roll 20 and the yarn 5 extending from the draw-off rolls 10, 11 is severed by snapping it. The start of the yarn 5 being drawn off from now on from the yarn delivery unit 1 by the draw-off rolls 10, 11 is introduced into the yarn holding device 30 formed as a suction air nozzle and sucked away steadily by it. The yarn 5 now extends along the line 52. The full bobbin is now substituted by an empty pirn 2.

By means of the recess 46 on the grabber 4, the yarn 5 extending along the line 52 is seized and guided over to underneath the yarn guide member 14. The yarn 5 lying on the line of grip against the endface of the auxiliary draw-off roll 12 is now introduced automatically into the line of grip between the auxiliary draw-off rolls 10, 12 and now gets positively drawn off from the draw-off rolls 10, 11. Hence, between the draw-off rolls 10, 11 and the auxiliary draw-off rolls 10, 12, a yarn forced conveyance zone 15 is formed in which the yarn 5 gets conveyed essentially without strain.

The operator now by means of the yarn deflector guides 44 and 45 (FIG. 2) on the grabber 34 seizes the section 51 of yarn extending in the yarn forced conveyance zone 15 and carries the yarn 5 by stretching it into the form of a loop 53 up to the yarn catcher beak 60 on the pirn disc 6. During this time, the yarn 5 is drawn through the yarn reflector guides 44 and 45 by means of the auxiliary draw-off rolls 10, 12 if the drawing out motion is slower than the yarn draw-off motion. In this way, it is guaranteed that the yarn in the yarn forced conveyance zone 15 is always taut and bunching up of the yarn cannot occur. The yarn catcher beak 60 seizes the taut yarn 5 and pulls it into the line of grip between the pirn 5 and the bobbin roll 20. The piece of yarn extending from the yarn catcher beak 60 to the yarn guide member 14 gets severed while the yarn 5 extending from the draw-off rolls 10, 11 to the pirn 2 gets wound up onto the pirn 2. Since the yarn 5, because of the yarn tension, arrives only gradually in the region of the traversing yarn guide 24, several spare turns are formed at the end of the pirn 2.

In solution of the object of the invention, it is essential that the yarn 5 extending from the draw-off rolls 10, 11 to the yarn holding device 30 is passed to auxiliary draw-off rolls 10, 12 so that the yarn 5 can be grasped in a yarn forced-conveyance zone 15 and drawn out as far as is necessary into the region of a yarn catcher device. In this way, even with coarser yarn counts, damming up between the draw-off rolls 10, 11 and the grabber 4 with the disadvantages already mentioned is avoided.

The grabber 4 may be formed in various ways, for example, after the style of the device shown in FIG. 7 of the U.S. patent application Ser. No. 724,521, in which the cutting mechanism has to be controlled by hand.

But because of the positive conveyance of the yarn, the yarn is always subjected to a draw-off tension so that the cutting device does not need to be controlled at all. In accordance with the present invention (FIG. 2), therefore, the yarn deflector guide 45 remote from the lateral center 27 of the pirn includes an edge which changes over into a recess 47 and which, with reference to its working position against the pirn 2, runs obliquely in direction to the working end remote from the handle 40 as well as to the yarn forced-conveyance zone 15 and at the end of which a stationary cutting edge 48 is arranged.

At the time of drawing out the yarn 5 into the region of the yarn catcher device 60 on the pirn 2, the yarn 5 is lying in the yarn deflector guides 44 and 45 and thus is not in the region of the stationary cutting edge 48. Only when the yarn catcher device 60 has grasped the yarn 5 and pulls it into the line of grip between the bobbin roller 20 and the pirn 2 does the yarn 5 arrive also in the region of the cutting edge 48. Since the yarn 5, because of the draw-off tension to which is is subjected in the yarn forced-conveyance zone 15, gets pulled hard against the cutting edge 48, the latter severs the yarn 5. Since the instant of severance depends upon the position of the yarn catcher device and, hence, upon the position of the yarn 5, an always equally long yarn end is guaranteed.

In order to be able to control the number of spare turns of yarn, the yarn deflector guide 44 next to the center 27 of the pirn is formed as a U-shaped recess. This recess is open at the edge remote from the yarn forced-conveyance zone 51. On the very end of the plate 42, remote from the handle 40, there is formed between the yarn deflector guide 44 and the end of the plate, a nose 49, so that the yarn deflector guide 44 acts doublesidedly. Besides feeding the yarn 5 in front of the yarn catcher device 60, the yarn deflector guide 44 brings it about, with its nose 49, that the yarn 5 extending from the draw-off rolls 10, 11 to the pirn 2 lies over the outside of the plate 42 through the yarn deflector guide 44, past the inside of the nose 49, and cannot run to the center 27 of the pirn into the region of the traversing yarn guide 24 as long as the grabber 4 is still lying in the transfer position. The length of time during which the operator leaves the grabber 4 in this position determines, therefore, the number of spare turns.

Figure 3:
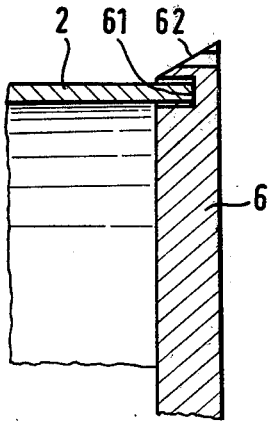
FIG. 3 is a longitudinal sectional view illustrating a part of the pirn and of the pirn disc of FIG. 1 in a preferred form of the invention.

The yarn catcher device 60, too, may be formed in different ways, for example, as a brush. In the embodiment shown and described, however, the yarn catcher device is arranged as a yarn catcher beak 60 orientated in the direction 26 of rotation of the pirn, on the pirn disc 6 which in diameter projects beyond the diameter of the pirn 2. The yarn 5 can be transferred to the yarn catcher beak particularly safely since the yarn deflector guide 45 reaches into the working region of the yarn catcher beak 60 further towards the center axis 28 of the pirn than the yarn deflector guide 44. In order to prevent the spare turns from dropping off the pirn when removing a full pirn, it has proved particularly advantageous if the pirn disc 6 is formed in such a way that it exhibits a recess 61 which partially receives the pirn 2. The recess 61 may be circular or annular, and has an outer face 62 which projects beyond the end of the pirn 2 in a ring and slopes off conically in the direction towards the center 27 of the pirn (FIG. 3). During their formation, the spare turns are guided by the conical outer face 62 of the pirn disc 6 into the direction towards the pirn 2, so that with the bobbin full, they exhibit a certain gap from the edge of the pirn. Because of the yarn tension created in the yarn forced-conveyance zone 15, the spare turns of yarn in this way arrive at the start in such a position that they exhibit the necessary safety-clearance from the edge of the pirn.

As the foregoing description shows, the present invention enables the secure winding of yarn 5 onto the new pirn 2 at the time of bobbin change from the start onwards. Moreover, the object of the invention may be altered in maniford ways. Also, it is not necessary for the grabber 4 to be actuated by hand, but it may be a component of an automatic mechanism which is provided individually per spinning unit or in common for a plurality of spinning units. In the latter case, the grabber may, for example, by arranged on a carriage or slide which can travel along the machine exhibiting a plurality of spinning units and be brought in a suitable way to the respective working positions.

Also, it is unnecessary for the yarn 5 to be drawn out into the region of the yarn catcher device by stretching. On the contrary, one of the two draw-off mechanisms 10, 11 or 10, 12 may also be so formed that an appropriate pulling action on the yarn 5 allows a slip which enables the drawing out of the yarn 5 in the form of a loop 53. If the yarn holding device 30 exerts a strong pull on the yarn, under certain circumstances with fine yarn counts, even the auxiliary draw-off rolls 10, 12 may be omitted.

While a preferred embodiment of the invention has been described using specific terms, such description is for illustrative purposes only, and it is to be understood that changes and variations may be made without departing from the spirit or scope of the following claims.

What is claimed is:

1. A method of picking up a yarn and transferring it to an empty pirn following exchange with a full bobbin on a yarn winding unit wherein said yarn is extended between a draw-off mechanism and a yarn holding device following severance from said full bobbin comprising the steps of:

providing an auxiliary draw-off mechanism between said draw-off mechanism and said yarn holding device, positively drawing said yarn from said draw-off mechanism by said auxiliary draw-off mechanism to produce a forced-conveyance zone between said draw-off mechanism and said auxiliary draw-off mechanism, and picking up said yarn in said forced-conveyance zone and drawing out the yarn into the region of said empty pirn for transfer thereto.

2. Apparatus for use in picking up a yarn and transferring it to an empty pirn following exchange with a full bobbin on a yarn winding unit having a draw-off mechanism for drawing off the yarn from a yarn delivery unit and delivering the yarn to said pirn for winding thereon, and a yarn holding device for receiving a severed end of said yarn and holding said yarn extending from said draw-off mechanism during exchange of said pirn with said full bobbin, said apparatus comprising:

an axuiliary draw-off mechanism arranged between said first mentioned draw-off mechanism and said yarn holding device, said auxiliary draw-off mechanism positively drawing said yarn from off said first draw-off mechanism to produce a yarn forced-conveyance zone therebetween in which said yarn is conveyed essentially without strain, and said auxiliary draw-off mechanism being disposed adjacent said winding unit so that said yarn in said forced-conveyance zone extends generally transverse to a path defined by the yarn when extending between said first draw-off mechanism and said pirn for winding thereon.

3. The apparatus of claim 2 wherein said first and auxiliary draw-off mechanisms are laterally spaced in essentially a side-by-side relationship wherein at least one yarn guide is disposed therebetween for feeding yarn to said auxiliary draw-off mechanism.

4. The apparatus of claim 3 wherein said first draw-off mechanism and said auxiliary draw-off mechanism comprise sets of draw-off rolls having a common driven draw-off roll and individual pressure rolls.

5. A method of picking up a yarn and transferring it to an empty pirn following exchange with a full bobbin on a yarn winding unit wherein said yarn extending between a draw-off mechanism and a yarn holding device is caught, extended to said pirn, fixed thereto and severed between said pirn and said yarn holding device, comprising the steps of:

positively drawing said yarn from said draw-off mechanism at an intermediate point between said draw-off mechanism and said yarn holding device to produce a forced-conveyance zone over the length of said yarn extending between said draw-off mechanism and said intermediate point, said yarn being conveyed essentially without strain in said forced-conveyance zone, and picking up said yarn in said forced-conveyance zone and drawing out the yarn into the region of said empty pirn for transfer thereto.

* * * * *